US010068537B2

(12) United States Patent
Lee et al.

(10) Patent No.: US 10,068,537 B2
(45) Date of Patent: Sep. 4, 2018

(54) IMAGE PROCESSOR, DISPLAY DEVICE INCLUDING THE SAME AND METHOD FOR DRIVING DISPLAY PANEL USING THE SAME

(71) Applicant: Samsung Display Co., Ltd., Yongin, Gyeonggi-Do (KR)

(72) Inventors: Dong-Gyu Lee, Seoul (KR); Joon-Chul Goh, Hwaseong-si (KR); Jung-Won Kim, Seoul (KR); Nam-Gon Choi, Yongin-si (KR); Ja-Kyoung Jin, Daegu (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 239 days.

(21) Appl. No.: 14/579,412

(22) Filed: Dec. 22, 2014

(65) Prior Publication Data

US 2015/0243199 A1 Aug. 27, 2015

(30) Foreign Application Priority Data

Feb. 27, 2014 (KR) ..... 10-2014-0023010

(51) Int. Cl.
*G09G 5/10* (2006.01)
*G09G 3/36* (2006.01)

(52) U.S. Cl.
CPC ... *G09G 3/3648* (2013.01); *G09G 2320/0252* (2013.01); *G09G 2340/0457* (2013.01); *G09G 2340/16* (2013.01)

(58) Field of Classification Search
CPC .... G09G 3/36; G09G 3/3648; G09G 2320/02; G09G 2320/0252; G09G 2320/0257; G09G 2320/029; G09G 2320/046; G09G 2340/16
USPC ..... 345/690, 691, 694, 696, 214
See application file for complete search history.

(56) References Cited

U.S. PATENT DOCUMENTS 6,549,209 B1 * 4/2003 Shinohara ..... G06T 15/005 345/531
6,628,247 B2 * 9/2003 Toffolo ..... G09G 3/007 345/31
7,719,530 B2 * 5/2010 Ono ..... G09G 3/007 345/204
7,868,947 B2 * 1/2011 Takeuchi ..... G06T 3/4007 348/441

(Continued)

FOREIGN PATENT DOCUMENTS

JP 2000-231364 A 8/2000
JP 2000-330539 A 11/2000

(Continued)

*Primary Examiner* — Jason Mandeville
(74) *Attorney, Agent, or Firm* — Knobbe Martens Olson & Bear LLP

(57) ABSTRACT

An image processor, a display device including the same, and a method for driving display panel using the same are disclosed. In one aspect, the display device includes an image shifter configured to shift a data signal by at least one pixel based at least in part on a shift start signal and output the shifted data signal and a shift direction signal. The display device also includes an image buffer configured to output current data and previous data based at least in part on the shifted data signal and the shift direction signal. The display device also includes an image mixer configured to mix the current data and the previous data over M frames starting at a start frame when the shift start signal is received and output image data, M being a natural number.

5 Claims, 10 Drawing Sheets

(56) References Cited

U.S. PATENT DOCUMENTS 8,471,787 B2 * 6/2013 Ihata ..... G09G 3/3208 345/76
8,643,581 B2 * 2/2014 Kikuta ..... G09G 3/3225 345/100
8,780,144 B2 * 7/2014 Kikuta ..... G09G 3/3233 345/690
9,330,623 B2 * 5/2016 Lee ..... G09G 3/3648
2003/0202780 A1 * 10/2003 Dumm ..... G06T 3/4007 386/345
2006/0007080 A1 1/2006 Yeh
2007/0024608 A1 * 2/2007 Sakuragi ..... G09G 3/007 345/204
2007/0103585 A1 * 5/2007 Takeuchi ..... G06T 3/4007 348/441
2008/0111886 A1 * 5/2008 Bai ..... G09G 3/20 348/173
2008/0211802 A1 9/2008 Yun et al.
2015/0077406 A1 * 3/2015 Lee ..... G09G 3/3648 345/204
2016/0189336 A1 * 6/2016 Lee ..... G06T 1/60 345/589

FOREIGN PATENT DOCUMENTS

JP 2009-163172 A 7/2009
JP 2010-066384 A 3/2010
KR 10-2005-0105574 A 11/2005
KR 10-2007-0062836 A 6/2007
KR 10-2008-0032333 A 4/2008
KR 10-2009-0090657 A 8/2009

* cited by examiner

IMAGE PROCESSOR, DISPLAY DEVICE INCLUDING THE SAME AND METHOD FOR DRIVING DISPLAY PANEL USING THE SAME

INCORPORATION BY REFERENCE TO ANY PRIORITY APPLICATIONS

This application claims priority under 35 U.S.C. § 119 to Korean Patent Application No. 10-2014-0023010, filed on Feb. 27, 2014, and all the benefits accruing therefrom, the content of which is herein incorporated by reference in its entirety.

BACKGROUND

Field

The described technology generally relates to an image processor, a display device including the image processor and a method for driving a display panel using the image processor.

Description of the Related Technology

Flat panel displays (FPDs) are being widely used as display devices because they are scalable, thin and light-weight. Examples of FPDs include liquid crystal displays (LCDs), plasma display panels, organic light-emitting diode (OLED) displays and the like.

SUMMARY OF CERTAIN INVENTIVE ASPECTS

One inventive aspect is an image processor that can prevent perception of image pixel-movement.

Another aspect is a display device including the image processor.

Another aspect is a method of driving a display panel using the image processor.

Another aspect is an image processor that includes an image shifter, an image buffer and an image mixer. The image shifter is configured to output a shift data signal and a shift direction signal, the shift data signal being generated by pixel-shifting a data signal in response to a shift start signal. The image buffer is configured to output current data and previous data based on the shift data signal and the shift direction signal. The image mixer is configured to mix and output the current data and the previous data over M of frames starting from a frame receiving the shift start signal, M being a natural number.

In an embodiment, the image mixer is configured to reduce a ratio of the previous data and to increase a ratio of the current data while the M of frames progress.

In an embodiment, the image mixer is configured to linearly reduce a ratio of the previous data and to linearly increase a ratio of the current data while the M of frames progress.

In an embodiment, the image mixer is configured to reduce a ratio of the previous data by a predetermined reducing rate and to increase a ratio of the current data by a predetermined increasing rate while the M of frames progress.

In an embodiment, the current data and the previous data respectively include first color data, second color data and third color data, which respectively correspond to pixels. The image mixer is configured to mix the first color data of the previous data with the first color data of the current data, to mix the second color data of the previous data with the second color data of the current data, and to mix the third color data of the previous data with the third color data of the current data for each of the pixels.

In an embodiment, the image shifter is configured to pixel-shift the data signal in a first direction or in a third direction opposite to the first direction.

In an embodiment, the image buffer includes a first line memory configured to store (m+1)-th line data of the shift data signal and to output m-th line data of the shift data signal as the current line data, a second line memory configured to store the m-th line data and to output (m−1)-th line data of the shift data signal, and a first selector configured to output one of the (m+1)-th line data and the (m−1)-th line data as the previous line data based on the shift direction signal.

In an embodiment, the image shifter is configured to pixel-shift the data signal in a second direction perpendicular to a first direction or in a fourth direction opposite to the second direction.

In an embodiment, the image buffer includes a first pixel memory configured to store (n+1)-th pixel data of the shift data signal and to output n-th pixel data of the shift data signal as the current pixel data, a second pixel memory configured to store the n-th pixel data and to output (n−1)-th pixel data of the shift data signal, and a first selector configured to output one of the (n+1)-th pixel data and the (n−1)-th pixel data as the previous pixel data based on the shift direction signal.

Another aspect is a display device that includes a display panel, an image processor and a data driver. The display panel is configured to display an image. The image processor includes an image shifter, an image buffer and an image mixer. The image shifter is configured to output a shift data signal and a shift direction signal, the shift data signal being generated by pixel-shifting a data signal in response to a shift start signal. The image buffer is configured to output current data and previous data based on the shift data signal and the shift direction signal. The image mixer is configured to mix the current data and the previous data over M of frames starting from a frame receiving the shift start signal to output a first data signal, M being a natural number. The data driver is configured to output a data voltage to the display panel based on the first data signal.

In an embodiment, the image mixer is configured to reduce a ratio of the previous data and to increase a ratio of the current data while the M of frames progress.

In an embodiment, the current data and the previous data respectively include first color data, second color data and third color data, which respectively correspond to pixels. The image mixer is configured to mix the first color data of the previous data with the first color data of the current data, to mix the second color data of the previous data with the second color data of the current data, and to mix the third color data of the previous data with the third color data of the current data for each of the pixels.

In an embodiment, the image shifter is configured to pixel-shift the data signal in a first direction or in a third direction opposite to the first direction. The image buffer includes a first line memory configured to store (m+1)-th line data of the shift data signal and to output m-th line data of the shift data signal as the current line data, a second line memory configured to store the m-th line data and to output (m−1)-th line data of the shift data signal, and a first selector configured to output one of the (m+1)-th line data and the (m−1)-th line data as the previous line data based on the shift direction signal.

In an embodiment, the image shifter is configured to pixel-shift the data signal in a second direction perpendicular to a first direction or in a fourth direction opposite to the second direction. The image buffer includes a first pixel memory configured to store (n+1)-th pixel data of the shift data signal and to output n-th pixel data of the shift data signal as the current pixel data, a second pixel memory configured to store the n-th pixel data and to output (n−1)-th pixel data of the shift data signal, and a first selector configured to output one of the (n+1)-th pixel data and the (n−1)-th pixel data as the previous pixel data based on the shift direction signal.

Another aspect is a method for driving a display panel. In the method, a shift data signal is generated by pixel-shifting a data signal in response to a shift start signal and outputted. The shift data signal is stored in an image buffer. Current data and previous data are outputted from the shift data signal. The current data and the previous data are mixed over M of frames starting from a frame receiving the shift start signal to output a first data signal, M being a natural number. A data voltage is outputted to a display panel based on the first data signal.

In an embodiment, a ratio of the previous data is reduced, and a ratio of the current data is increased, while the M of frames progress.

In an embodiment, the data signal is pixel-shifted in a first direction or in a third direction opposite to the first direction. (m+1)-th line data of the shift data signal is stored, and m-th line data of the shift data signal is outputted as the current line data. The m-th line data is stored, and (m−1)-th line data of the shift data signal is outputted. One of the (m+1)-th line data and the (m−1)-th line data is outputted as the previous line data based on the shift start signal.

In an embodiment, the data signal is pixel-shifted in a second direction perpendicular to a first direction or in a fourth direction opposite to the second direction. (n+1)-th pixel data of the shift data signal is stored, and n-th pixel data of the shift data signal is outputted as the current pixel data. The n-th pixel data is stored, and (n−1)-th pixel data of the shift data signal is outputted. One of the (n+1)-th pixel data and the (n−1)-th pixel data is outputted as the previous pixel data based on the shift start signal.

In an embodiment, the current data and the previous data respectively include first color data, second color data and third color data, which respectively correspond to pixels. The first color data of the previous data is mixed with the first color data of the current data, wherein the second color data of the previous data is mixed with the second color data of the current data, wherein the third color data of the previous data is mixed with the third color data of the current data for each of the pixels.

According to at least one of the disclosed embodiments, an image is gradually shifted over a plurality of frames. Thus, pixel-shifting is not perceived. Thus, display quality can be improved.

An image processor for a display device, comprising an image shifter configured to shift a data signal by at least one pixel based at least in part on a shift start signal and output the shifted data signal and a shift direction signal. The image processor also comprises an image buffer configured to output current data and previous data based at least in part on the shifted data signal and the shift direction signal. The image processor further comprises an image mixer configured to mix the current data and the previous data over M frames starting at a start frame when the shift start signal is received and output image data, wherein M is a natural number.

In the above image processor, the image mixer is further configured to reduce a ratio of the previous data to the current data while the frames progress away from the start frame.

In the above image processor, the image mixer is further configured to substantially linearly reduce the ratio while the frames progress away from the start frame.

In the above image processor, the image mixer is further configured to reduce the ratio by a predetermined rate while the frames progress away from the start frame.

In the above image processor, the current data and the previous data each includes first to third color data, which correspond to a plurality of pixels, wherein the image mixer is further configured to, for each of the pixels, mix the first color data of the previous data with the first color data of the current data, the second color data of the previous data with the second color data of the current data, and the third color data of the previous data with the third color data of the current data for each of the pixels.

In the above image processor, the image shifter is further configured to shift the data signal by at least one pixel in a first direction or in a third direction opposite to the first direction.

In the above image processor, the shifted data signal comprises (m+1)-th, m-th and (m−1)-th line data, wherein the image buffer includes a first line memory configured to store the (m+1)-th line data and output the m-th line data as the current line data. In the above image processor, the image buffer also includes a second line memory configured to store the m-th line data and output the (m−1)-th line data. In the above image processor, the image buffer further includes a first selector configured to output one of the (m+1)-th line data and the (m−1)-th line data as the previous line data based at least in part on the shift direction signal.

In the above image processor, the image shifter is further configured to shift the data signal by at least one pixel in a second direction crossing a first direction or in a fourth direction opposite to the second direction.

In the above image processor, the shifted data signal comprises (n+1)-th, n-th and (n−1)-th line data, wherein the image buffer includes a first pixel memory configured to store the (n+1)-th pixel data and output the n-th pixel data as the current pixel data. In the above image processor, the image buffer also includes a second pixel memory configured to store the n-th pixel data and output the (n−1)-th pixel data. In the above image processor, the image buffer further includes a first selector configured to output one of the (n+1)-th pixel data and the (n−1)-th pixel data as the previous pixel data based at least in part on the shift direction signal.

Another aspect is a display device comprising a display panel configured to display an image, an image processor electrically connected to the display panel. The image processor includes an image shifter configured to shift a data signal by at least one pixel based at least in part on a shift start signal and output the shifted data signal and a shift direction signal. The image processor includes an image buffer configured to output current data and previous data based at least in part on the shifted data signal and the shift direction signal. The image processor includes an image mixer configured to mix the current data and the previous data over M frames starting at a start frame when the shift start signal is received and output a first data signal, wherein M is a natural number. The display device also includes a data driver configured to output a data voltage to the display panel based at least in part on the first data signal.

In the above display device, the image mixer is further configured to reduce a ratio of the previous data to the current data while the M of frames progress away from the start frame.

In the above display device, the current data and the previous data each includes first to third color data, which correspond to a plurality of pixels, wherein the image mixer is further configured to, for each of the pixels, mix the first color data of the previous data with the first color data of the current data, the second color data of the previous data with the second color data of the current data, and the third color data of the previous data with the third color data of the current data for each of the pixels.

In the above display device, the image shifter is further configured to shift the data signal by at least one pixel in a first direction or in a third direction opposite to the first direction, wherein the shifted data signal comprises (m+1)-th, m-th and (m−1)-th line data, and wherein the image buffer includes a first line memory configured to store the (m+1)-th line data and output the m-th line data as the current line data. In the above display device, the image buffer also includes a second line memory configured to store the m-th line data and output the (m−1)-th line data and a first selector configured to output one of the (m+1)-th line data and the (m−1)-th line data as the previous line data based at least in part on the shift direction signal.

In the above display device, the image shifter is further configured to shift the data signal by at least one pixel in a second direction crossing a first direction or in a fourth direction opposite to the second direction, wherein the shifted data signal comprises (n+1)-th, n-th and (n−1)-th line data, and wherein the image buffer includes a first pixel memory configured to the store (n+1)-th pixel data and output the n-th pixel data as the current pixel data. In the above display device, the image buffer further includes a second pixel memory configured to store the n-th pixel data and output (n−1)-th pixel data and a first selector configured to output one of the (n+1)-th pixel data and the (n−1)-th pixel data as the previous pixel data based at least in part on the shift direction signal.

Another aspect is a method for driving a display panel, the method comprising pixel-shifting a data signal by at least one pixel based at least in part on a shift start signal so as to output the shift data signal, storing the shift data signal in an image buffer, outputting current data and previous data from the shift data signal, mixing the current data and the previous data over M frames starting from a start frame when the shift start signal is received so as to output a data signal, wherein M is a natural number. The method also includes outputting a data voltage to a display panel based at least in part on the data signal.

In the above method, the ratio of the previous data to the current data decreases while the frames progress away from the start frame.

In the above method, the mixing comprises substantially linearly reducing the ratio while the frames progress away from the start frame.

In the above method, the pixel-shifting comprises pixel-shifting the data signal in a first direction or in a third direction opposite to the first direction, wherein the shifted data signal comprises (m+1)-th, m-th and (m−1)-th line data. In the above method, the outputting of the current data and the previous data comprises storing the (m+1)-th line data and outputting m-th line data as the current line data, storing the m-th line data and outputting the (m−1)-th line data, and outputting one of the (m+1)-th line data and the (m−1)-th line data as the previous line data based at least in part on the shift start signal.

In the above method, the pixel-shifting comprises pixel-shifting the data signal in a second direction crossing a first direction or in a fourth direction opposite to the second direction, wherein the shift data signal comprises (n+1)-th, n-th and (n−1)-th line data. In the above method, the outputting of the current data and the previous data comprises storing (n+1)-th pixel data and outputting the n-th pixel data as the current pixel data, storing the n-th pixel data and outputting (n−1)-th pixel data, and outputting one of the (n+1)-th pixel data and the (n−1)-th pixel data as the previous pixel data based at least in part on the shift start signal.

In the above method, the current data and the previous data each include first to third color data, which correspond to a plurality pixels, wherein, for each of the pixels, the first color data of the previous data is mixed with the first color data of the current data, wherein the second color data of the previous data is mixed with the second color data of the current data, and wherein the third color data of the previous data is mixed with the third color data of the current data for each of the pixels.

DETAILED DESCRIPTION OF CERTAIN INVENTIVE EMBODIMENTS

When the same image is displayed on a screen of a liquid crystal display, alignment of liquid crystal molecules can be fixed. Thus, an afterimage can remain even when a different image is displayed. In order to prevent the afterimage, a method of displaying an artificial moving image, known as a screensaver, can be used. However, the method cannot be used when the same image needs to be displayed for a long time. Thus, a method of shifting an image in a vertical direction or in a horizontal direction by predetermined pixels has been developed. However, when the image is shifted, the entire image is moved. Thus, a viewer can perceive an entire image being shifted.

Exemplary embodiments will be described more fully hereinafter with reference to the accompanying drawings, in which various embodiments are shown. In this disclosure, the term "substantially" includes the meanings of completely, almost completely or to any significant degree under some applications and in accordance with those skilled in the art. Moreover, "formed on" can also mean "formed over." The term "connected" can include an electrical connection.

Figure 1:
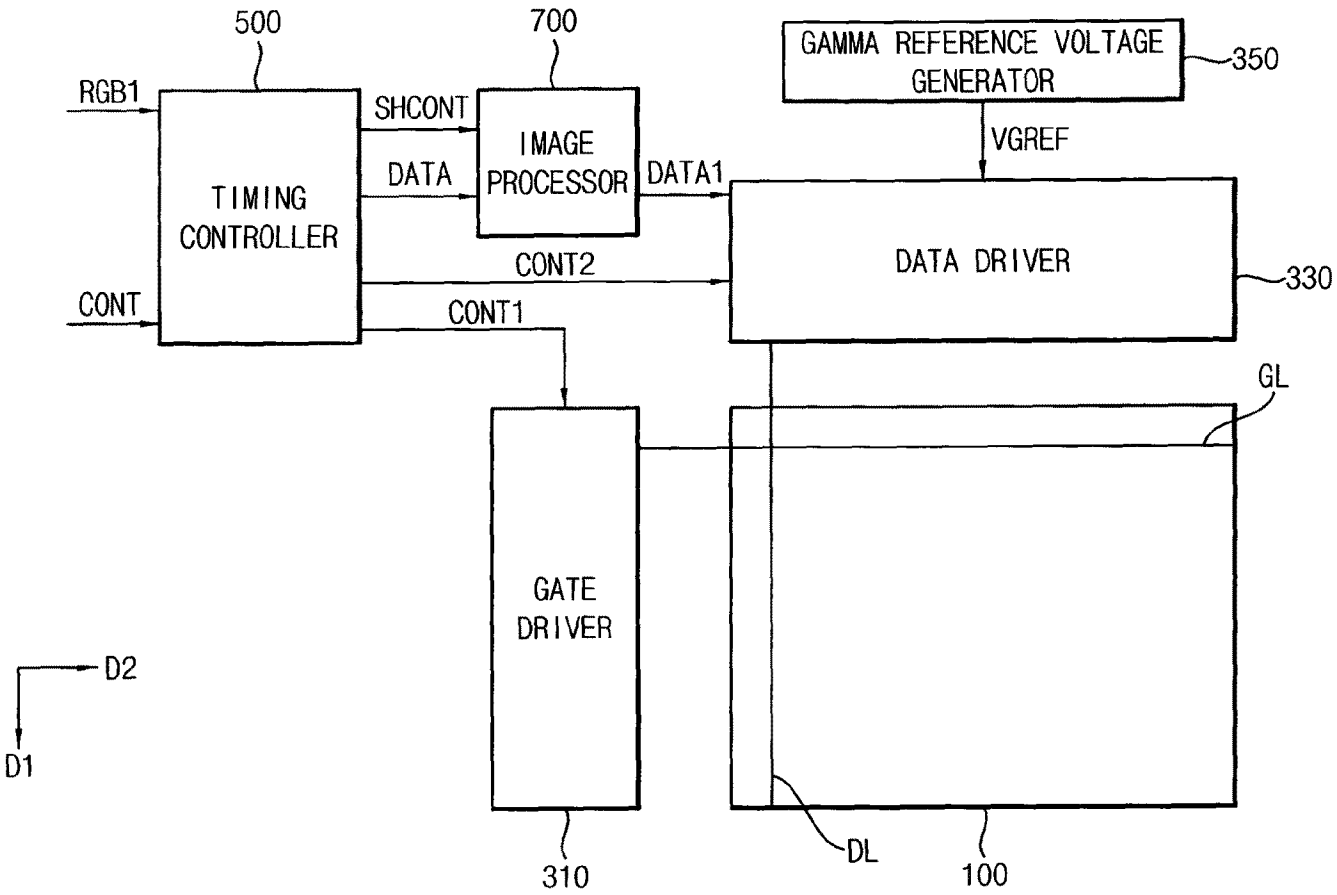
FIG. 1 is a block diagram illustrating a display device according to an exemplary embodiment.
Figure 2:
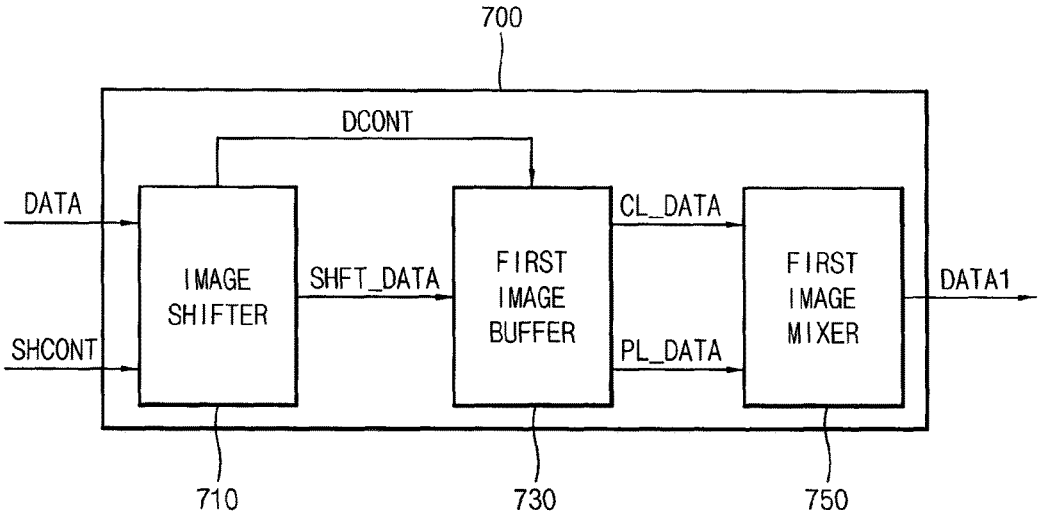
FIG. 2 is a block diagram illustrating the image processor of FIG. 1.
Figure 3:
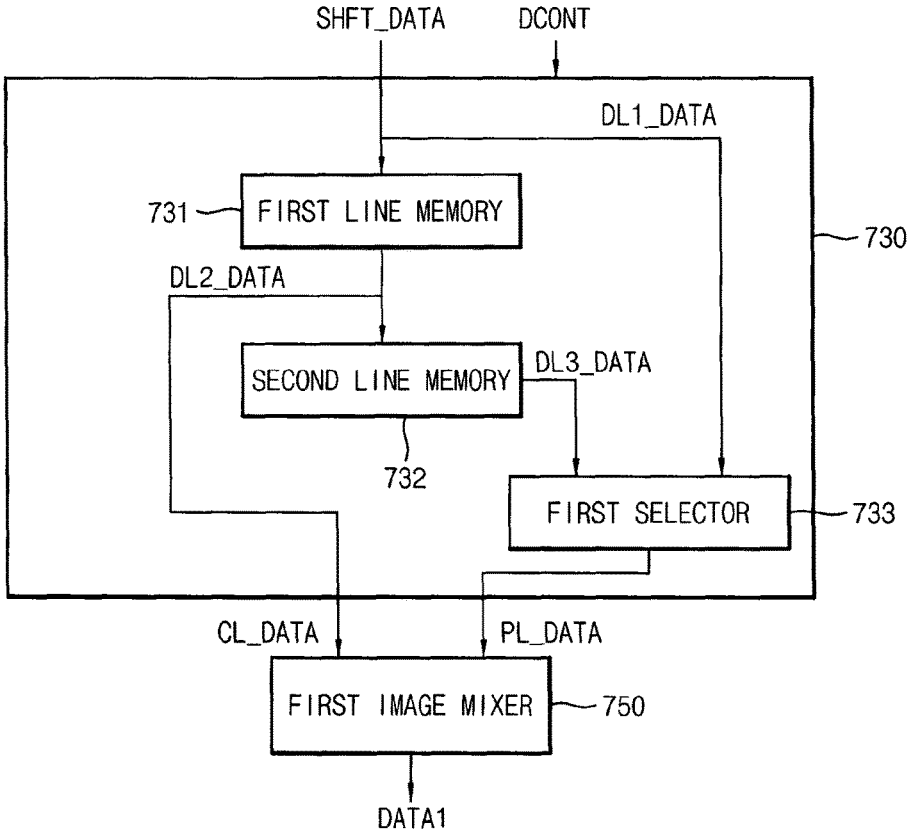
FIG. 3 is a block diagram illustrating the first image buffer and the first image mixer of FIG. 2.

FIG. 1 is a block diagram illustrating a display device according to an exemplary embodiment. FIG. 2 is a block diagram illustrating the image processor of FIG. 1. FIG. 3 is a block diagram illustrating the first image buffer and the first image mixer of FIG. 2.

Referring to FIGS. 1 to 3, a display device includes a display panel 100, a gate driver 310, a data driver 330, a gamma reference voltage generator 350, a timing controller 500 and an image processor 700.

The display panel 100 displays an image. The display pane 100 includes a first substrate, a second substrate facing the first substrate, and a liquid crystal layer interposed between the first and second substrates.

The display panel 100 includes a plurality of pixels. Each of the pixels can include a red subpixel, a green subpixel, and a blue subpixel. In some embodiments, the pixel includes a cyan subpixel, a yellow subpixel, and a magenta subpixel. The pixel can further include a multi-primary subpixel.

The display panel 100 includes a plurality of gate lines GL and a plurality of data lines DL. The subpixels are electrically connected to the gate lines GL and the data lines DL. The data lines DL extend in a first direction D1, and the gate lines GL extend in a second direction D2 crossing the first direction D1.

Each of the subpixels includes a switching element, and a liquid crystal capacitor electrically connected to the switching element. Each of the subpixels can further include a storage capacitor. The subpixels are arranged in a matrix configuration. The switching element can be a thin film transistor.

The gate lines GL, the data lines DL, pixel electrodes and storage electrodes can be formed on the first substrate, and a common electrode can be formed on the second substrate.

The timing controller 500 receives input image data RGB and an input control signal CONT from an external device. The input image data RGB can include red image data R, green image data G and blue image data B. In some embodiments, input image data includes cyan image data C, yellow image data Y and magenta image data M. The input image data can further include multi-primary image data.

The input control signal can include a master clock signal, a data enable signal, a vertical sync signal, a horizontal sync signal and the like.

The timing controller 500 generates a first control signal CONT1, a second control signal CONT2, a shift start signal SHCONT and a data signal DATA based at least in part on the input image data RGB and the input control signal CONT.

The timing controller 500 generates the first control signal CONT1 for controlling driving timing of the gate driver 310 based at least in part on the input control signal CONT, and outputs the first control signal CONT1 to the gate driver 310. The first control signal CONT1 can include a vertical start signal, a gate clock signal and the like.

The timing controller 500 generates the second control signal CONT2 for controlling driving timing of the data driver 330 based at least in part on the input control signal CONT, and outputs the second control signal CONT2 to the data driver 330. The second control signal CONT2 can include a horizontal start signal, a load signal and the like.

The timing controller 500 generates the data signal DATA based at least in part on the input image data RGB, and outputs the data signal DATA to the image processor 700.

The timing controller 500 generates the shift start signal SHCONT based at least in part on the input image data RGB, and outputs the shift start signal SHCONT to the image processor 700. For example, when the input image data RGB includes substantially the same image for a predetermined number of frames, the shift start signal SHCONT is provided to the image processor 700 for M frames, wherein M is a natural number.

The image processor 700 pixel-shifts an image of the data signal DATA over a plurality of frames based at least in part on the shift start signal SHCONT to generate a first data signal DATA1, and outputs the first data signal DATA1 to the data driver 330. For example, the image processor 700 pixel-shifts the image by at least one pixel, which is one signal line, over consecutive M frames in the first direction D1 or in a third direction opposite the first direction D1 based at least in part on the shift start signal SHCONT.

Referring to FIG. 2, the image processor 700 includes an image shifter 710, a first image buffer 730 and a first image mixer 750.

The image shifter 710 can output a shift data signal SHFT_DATA, which is generated by pixel-shifting the data signal DATA in the first direction D1 or in the third direction based at least in part on the shift start signal SHCONT, and a shift direction signal DCONT.

The first image buffer 730 can output current line data CL_DATA and previous line data PL_DATA based at least in part on the shift data signal SHFT_DATA and the shift direction signal DCONT. When the shift start signal SHCONT is applied in a (K+1)th frame, the first image buffer 730 can output the current line data CL_DATA and the previous line data PL_DATA, which correspond to each data lines from the (K+1)th frame to a (K+M)th frame.

Referring to FIG. 3, the first image buffer 730 includes a first line memory 731, a second line memory, 732 and a first selector 733.

The first line memory 731 can output m-th line data DL2_DATA of the shift data signal SHFT_DATA and can store (m+1)-th line data DL1_DATA of the shift data signal SHFT_DATA. The m-th line data DL2_DATA can be outputted as the current line data CL_DATA.

The second line memory 732 can output (m−1)-th line data DL3_DATA of the shift data signal SHFT_DATA and can store the m-th line data DL2_DATA.

The first selector 733 can output one of the (m+1)-th line data DL1_DATA and the (m−1)-th line data DL3_DATA as the previous line data PL_DATA based on the shift direction signal DCONT.

For example, the (m+1)-th line data DL1_DATA is outputted as the previous line data PL_DATA so that the image is pixel-shifted in the first direction D1. The (m−1)-th line data DL3_DATA can be outputted as the previous line data PL_DATA so that the image can be pixel-shifted in the third direction, The (m−1)-th line data DL3_DATA, the m-th line data DL2_DATA and the (m+1)-th line data DL1_DATA respectively correspond to pixel rows formed adjacent to each other. The first image mixer 750 can mix the current line data CL_DATA and the previous line data PL_DATA over M frames starting from the frame receiving the shift start signal SHCONT to generate the first data signal DATA1. The first image mixer 750 can output the first data signal DATA1 to the data driver 330.

For example, the first image mixer 750 reduces a ratio of the previous line data PL_DATA and increases a ratio of the current line data CL_DATA while the M frames progress. For example, the first image mixer 750 substantially linearly reduces the ratio of the previous line data PL_DATA and substantially linearly increases the ratio of the current line data CL_DATA. For example, the ratio of the previous line data PL_DATA is substantially linearly reduced to be ((M−L)/M)*100%, and the ratio of the current line data CL_DATA is substantially linearly increased to be (L/M)*100%, while the M frames progress. L is a natural number between 1 to M.

When M is 4, the first image mixer 750 mixes the current line data CL_DATA and the previous line data PL_DATA over 4 frames starting from a first frame.

In the first frame, L is 1. In the first frame, the first image mixer 750 mixes about 25% of the current line data CL_DATA and about 75% of the previous line data PL_DATA.

In a second frame, L is 2. In the second frame, the first image mixer 750 mixes about 50% of the current line data CL_DATA and about 50% of the previous line data PL_DATA.

In a third frame, L is 3. In the third frame, the first image mixer 750 mixes about 75% of the current line data CL_DATA and about 25% of the previous line data PL_DATA.

In a fourth frame, L is 4. In the fourth frame, the first image mixer 750 mixes 100% of the current line data CL_DATA and 0% of the previous line data PL_DATA.

In some embodiments, the first image mixer 750 reduces the ratio of the previous line data PL_DATA by a predetermined reducing rate, and increases the ratio of the current line data CL_DATA by a predetermined increasing rate while the M frames progress.

The previous line data PL_DATA and the current line data CL_DATA can include red, green and blue image data, which respectively correspond to each of the pixels.

For example, the first image mixer 750 mixes red image data of the previous line data PL_DATA with red image data of the current line data CL_DATA, and mixes green image data of the previous line data PL_DATA with green image data of the current line data CL_DATA, and mixes blue image data of the previous line data PL_DATA with blue image data of the current line data CL_DATA.

In some embodiments, the previous line data PL_DATA and the current line data CL_DATA includes cyan, yellow and magenta image data. The previous line data PL_DATA and the current line data CL_DATA can further include multi-primary image data.

The first image mixer 750 can mix cyan image data of the previous line data PL_DATA with cyan image data of the current line data CL_DATA, and can mix yellow image data of the previous line data PL_DATA with yellow image data of the current line data CL_DATA, and can mix magenta image data of the previous line data PL_DATA with magenta image data of the current line data CL_DATA. Furthermore, the first image mixer 750 can mix multi-primary image data of the previous line data PL_DATA with multi-primary image data of the current line data CL_DATA.

Processes for pixel-shifting over a plurality of frames will be explained in detail with reference to FIG. 4 to FIG. 6D.

The gate driver 310 receives the first control signal CONT1 from the timing controller 500. The gate driver 310 generates gate signals for driving the gate lines GL based at least in part on the first control signal CONT1. The gate driver 310 sequentially outputs the gate signals to the gate lines GL.

The gamma reference voltage generator 350 generates a gamma reference voltage VGREF. The gamma reference voltage generator 350 provides the gamma reference voltage VGREF to the data driver 330. The gamma reference voltage VGREF can have values that correspond to the data signal DATA and the first data signal DATA1. The gamma reference voltage generator 350 can be formed in the data driver 330.

The data driver receives the second control signal CONT2 from the timing controller 500. The data driver 330 receives the first data signal DATA1 from the image processor 700. The data driver 330 receives the gamma reference voltage VGREF from the gamma reference voltage generator 350.

The data driver 330 converts the first data signal DATA1 into analog data voltages based at least in part on the gamma reference voltage VGREF. The data driver 330 outputs the data voltages to the data lines DL.

Figure 4:
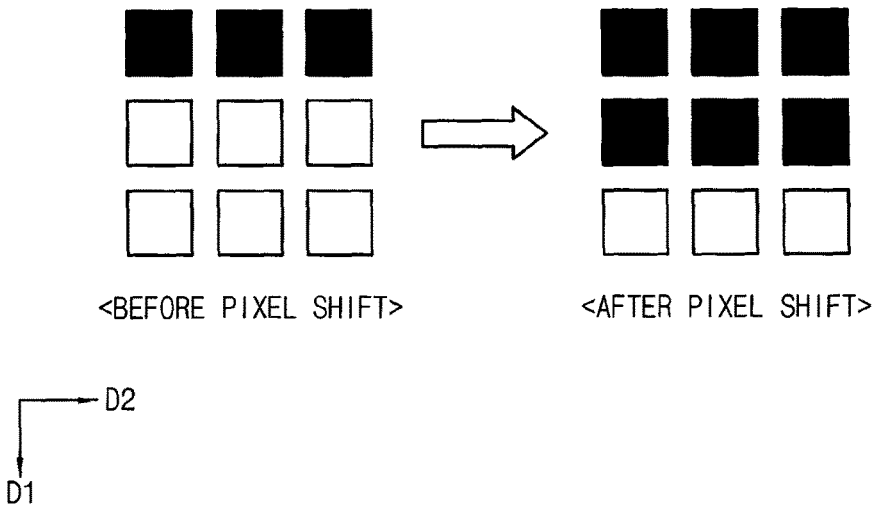
FIG. 4 is a schematic view illustrating an image before and after being shifted.
Figure 5:
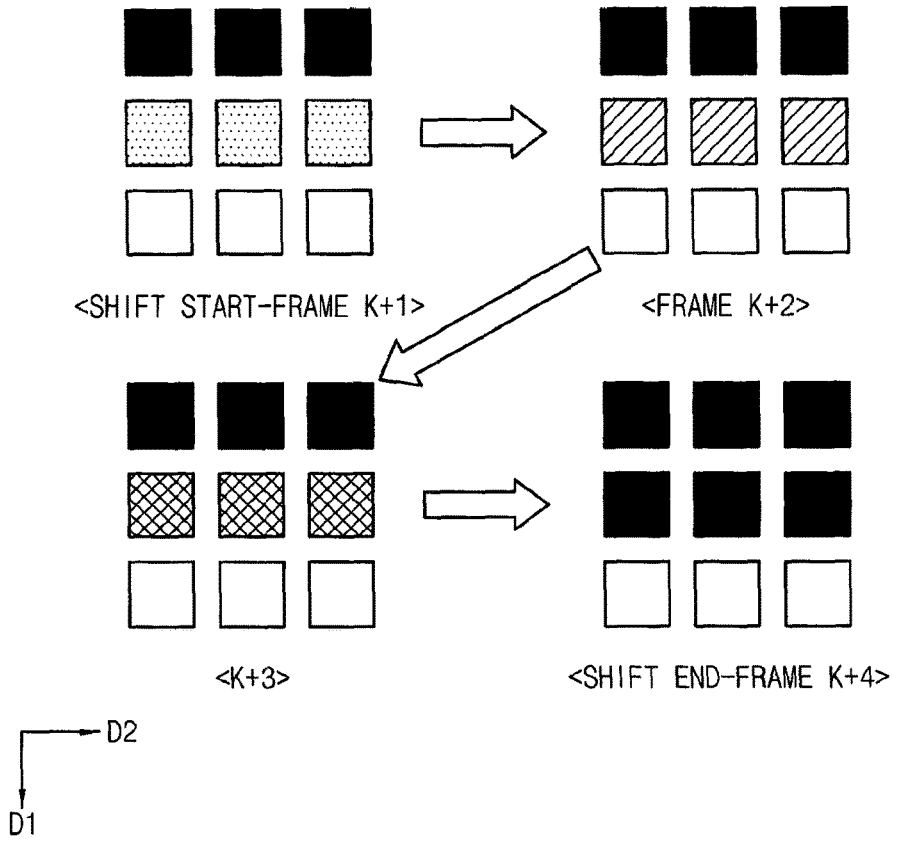
FIG. 5 is a schematic view explaining processes of shifting the image of FIG. 4.

FIG. 4 is a schematic view illustrating an image before and after being shifted. FIG. 5 is a schematic view explaining a process of shifting the image of FIG. 4.

Nine quadrangles illustrated in a left region of FIG. 4 are enlarged 9 pixels adjacent to each other in a display panel, and represent a state before pixel-shifting. Nine quadrangles illustrated in a right region of FIG. 4 are the same enlarged pixels as the pixels on the left, and represents a state after pixel-shifting in the first direction D1.

Each of the pixels can include a red subpixel, a green subpixel and a blue subpixel. In some embodiments, each of the pixels can include a cyan subpixel, a yellow subpixel, and a magenta subpixel. The pixel can further include a multi-primary subpixel.

The 9 pixels include a first pixel formed in a (m−1)-th row and in a (n−1)-th column, a second pixel formed in the (m−1)-th row and in a n-th column, a third pixel formed in the (m−1)-th row and in a (n+1)-th column, a fourth pixel formed in a m-th row and in the (n−1)-th column, a fifth pixel formed in the m-th row and in the n-th column, a sixth pixel formed in the m-th row and in the (n+1)-th column, a seventh pixel formed in the (m+1)-th row and in the (n−1)-th column, an eighth pixel formed in the (m+1)-th row and in the n-th column, and a ninth pixel formed in the (m+1)-th row and in the (n+1)-th column.

Before pixel-shifting, the first, second, and third pixels represent a first color, and the rest of the pixels represent a second color. For example, the first color is black, and the second color is white.

In some embodiments, the pixel-shifting occurs over 4 frames, however, is not limited thereto. For example, the pixel-shifting occurs over at least 2 frames.

For example, the pixel-shifting starts at (K+1)th frame and ends at (K+4)-th frame.

In the (K+1)-th frame, the first shift start signal SHCONT is applied to the image processor 700. Thus, the previous line data PL_DATA, which corresponds to data before the pixel-shifting, starts to be mixed with the current line data CL_DATA, which corresponds to data after the pixel-shifting in the first direction D1, in each line. Because a ratio of the current line data CL_DATA is less than a ratio of the previous line data PL_DATA in the (K+1)-th frame, the fourth to sixth pixels represent gray close to white in the (K+1)-th frame.

Because the ratio of the current line data CL_DATA is substantially the same as the ratio of the previous line data PL_DATA in the (K+2)-th frame, the fourth to sixth pixels represent gray between black and white in the (K+2)-th frame.

Because the ratio of the current line data CL_DATA is greater than the ratio of the previous line data PL_DATA in the (K+3)-th frame, the fourth to sixth pixels represent gray close to black in the (K+3)-th frame.

In the (K+4)-th frame, the ratio of the current line data CL_DATA becomes about 100%, and the ratio of the previous line data PL_DATA becomes about 0%. Thus, the fourth to sixth pixels represent black in the (K+4)-th frame.

FIG. 6A to FIG. 6D are schematic views explaining the processes of FIG. 5.

Figure 6A:
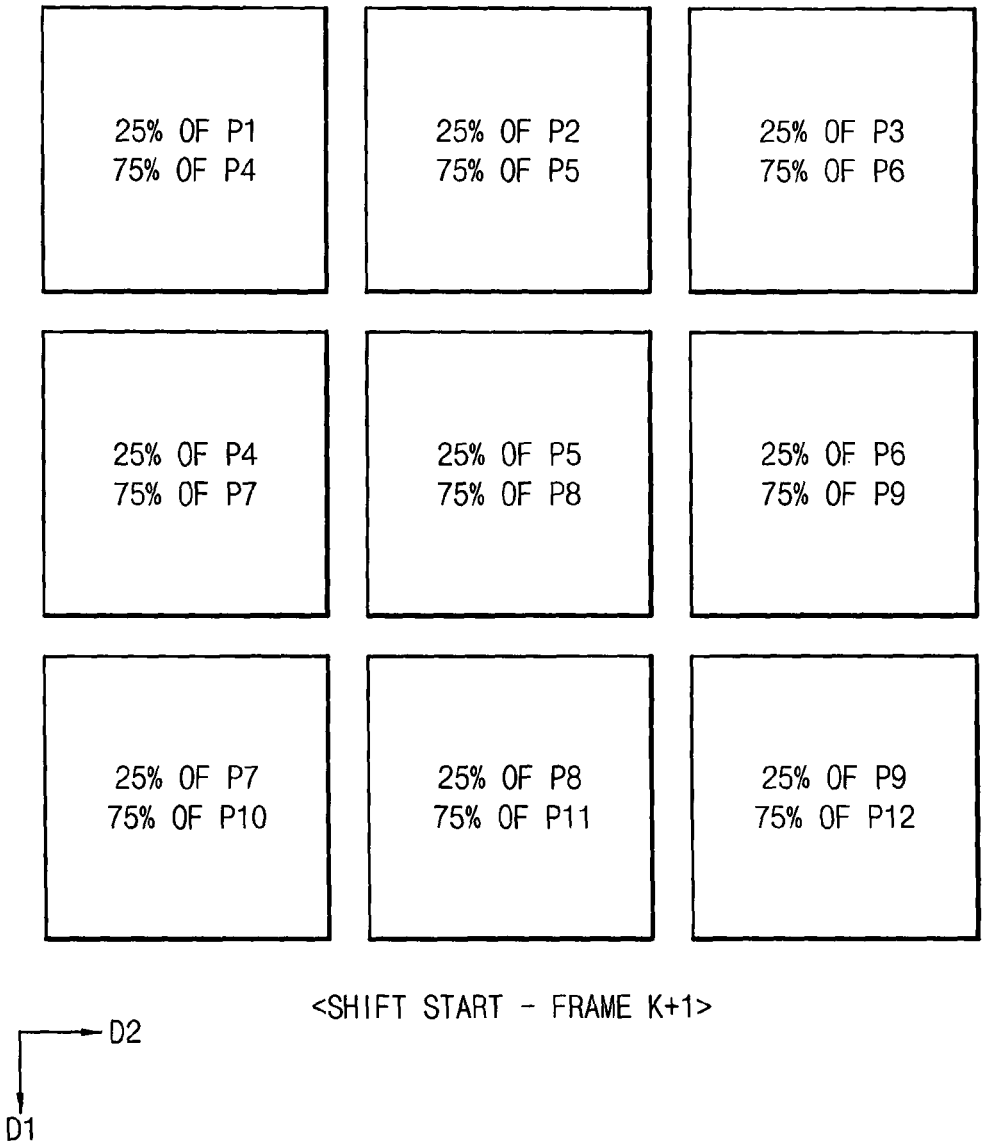
FIG. 6A to FIG. 6D are schematic views explaining the processes of FIG. 5.

Referring to FIG. 6A, mixing first input image data RGB1 and second input image data RGB2 for the first to ninth pixels in the (K+1)-th frame will be explained.

The current line data CL_DATA can include (m−1)-th row pixel data of the shift data signal SHFT_DATA in the (m−1)-th row. The (m−1)-th row pixel data can include first to third pixel data P1 to P3.

The previous line data PL_DATA can include m-th row pixel data of the shift data signal SHFT_DATA in the (m−1)-th row. The m-th row pixel data can include fourth to sixth pixel data P4 to P6.

About 75% of the fourth pixel data P4 corresponding to the first pixel and about 25% of the first pixel data P1 corresponding to the first pixel are mixed.

About 75% of the fifth pixel data P5 corresponding to the second pixel and about 25% of the second pixel data P2 corresponding to the second pixel are mixed.

About 75% of the sixth pixel data P6 corresponding to the third pixel and about 25% of the third pixel data P3 corresponding to the third pixel are mixed.

The current line data CL_DATA can include the m-th row pixel data of the shift data signal SHFT_DATA in the m-th row. The m-th row pixel data can include the fourth to sixth pixel data P4 to P6.

The previous line data PL_DATA can include (m+1)-th row pixel data of the shift data signal SHFT_DATA in the m-th row. The (m+1)-th row pixel data can include seventh to ninth pixel data P7 to P9.

About 75% of the seventh pixel data P7 corresponding to the fourth pixel and about 25% of the fourth pixel data P4 corresponding to the fourth pixel are mixed.

About 75% of the eighth pixel data P8 corresponding to the fifth pixel and about 25% of the fifth pixel data P5 corresponding to the fifth pixel are mixed.

About 75% of the ninth pixel data P9 corresponding to the sixth pixel and about 25% of the sixth pixel data P6 corresponding to the sixth pixel are mixed.

The current line data CL_DATA can include the (m+1)-th row pixel data of the shift data signal SHFT_DATA in the (m+1)-th row. The (m+1)-th row pixel data can include the seventh to ninth pixel data P7 to P9.

The previous line data PL_DATA can include (m+2)-th row pixel data of the shift data signal SHFT_DATA in the (m+1)-th row. The (m+2)-th row pixel data can include tenth to twelfth pixel data P10 to P12.

About 75% of the tenth pixel data P10 corresponding to the seventh pixel and about 25% of the seventh pixel data P7 corresponding to the seventh pixel are mixed.

About 75% of the eleventh pixel data P11 corresponding to the eighth pixel and about 25% of the eighth pixel data P8 corresponding to the eighth pixel are mixed.

About 75% of the twelfth pixel data P12 corresponding to the ninth pixel and about 25% of the ninth pixel data P9 corresponding to the ninth pixel are mixed.

Figure 6B:
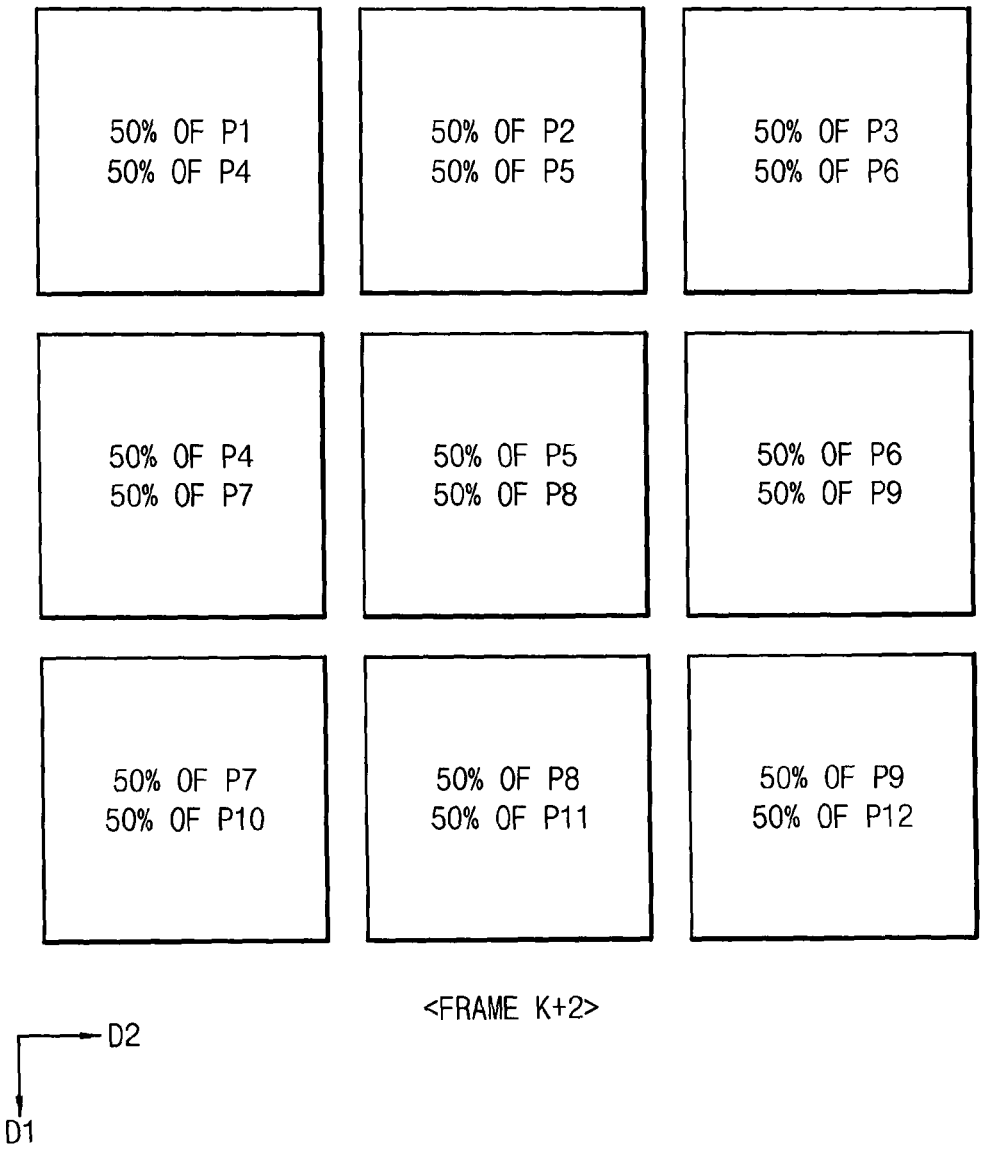

Referring to FIG. 6B, the previous line data PL_DATA corresponding to the first to ninth pixels and the current line data CL_DATA corresponding to the first to ninth pixels are mixed with each other in the (K+2)-th frame such that the mixing ratio is about 50 to about 50.

Figure 6C:
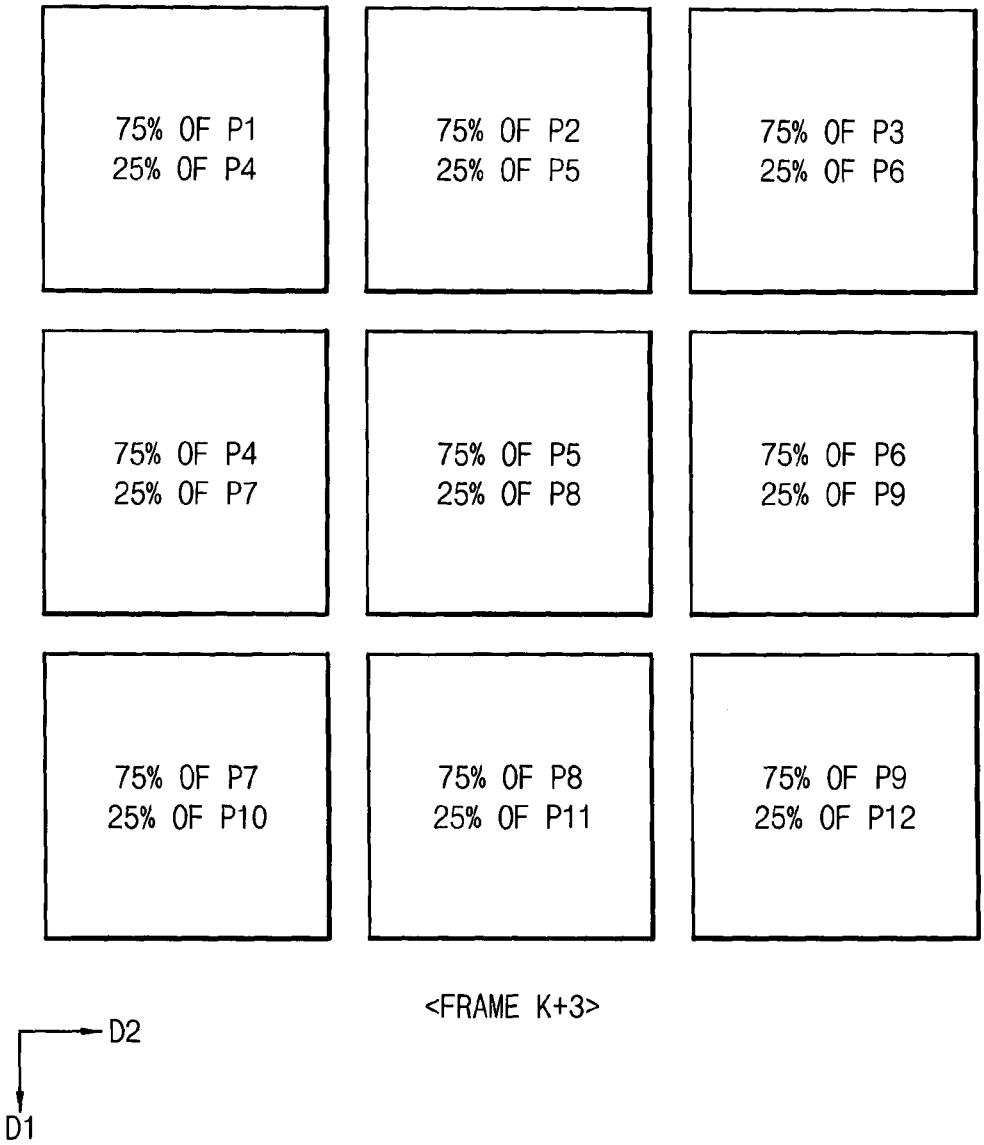

Referring to FIG. 6C, the previous line data PL_DATA corresponding to the first to ninth pixels and the current line data CL_DATA corresponding to the first to ninth pixels are mixed with each other in the (K+3)-th frame such that the mixing ratio is about 25 to about 75.

Figure 6D:
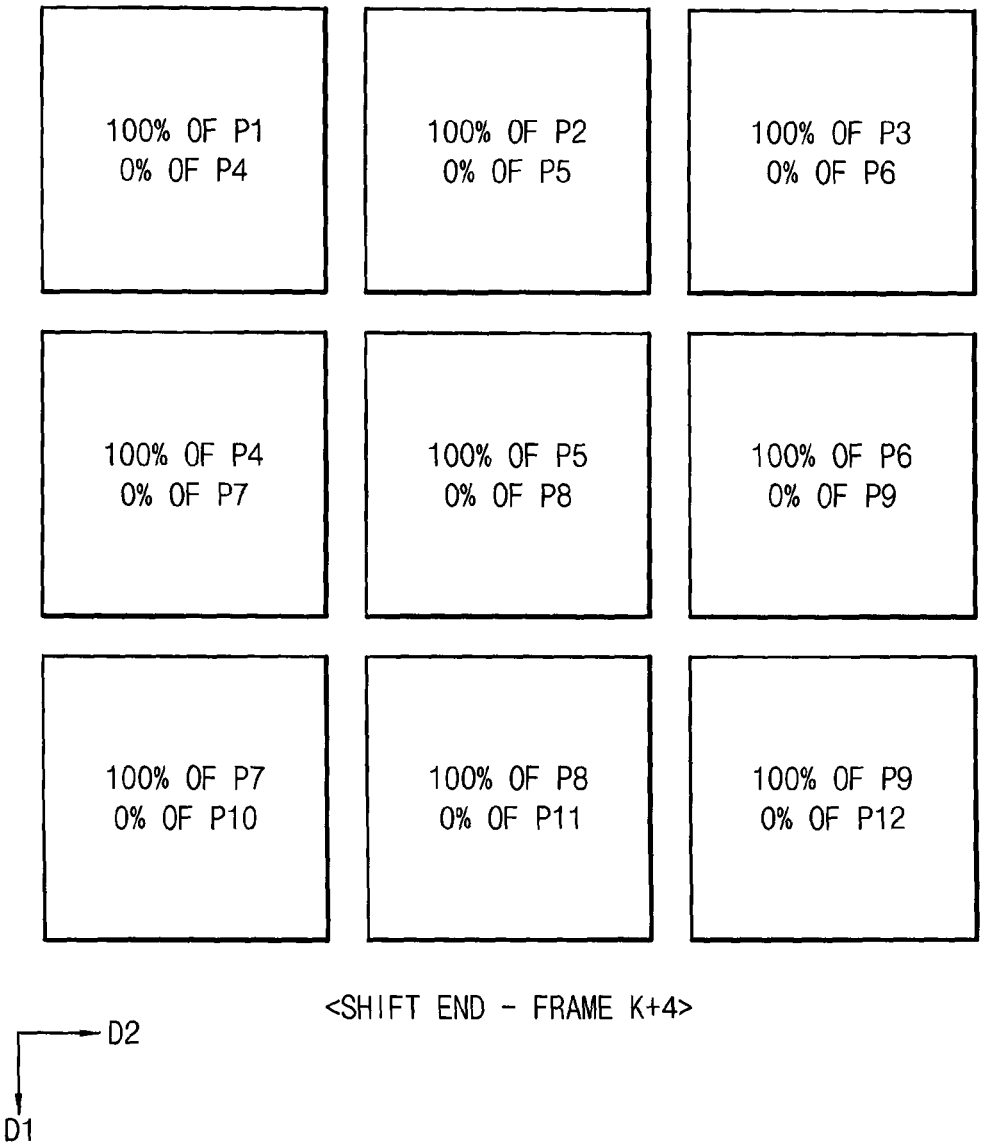

Referring to FIG. 6D, the previous line data PL_DATA corresponding to the first to ninth pixels and the current line data CL_DATA corresponding to the first to ninth pixels are mixed with each other in the (K+4)-th frame such that the mixing ratio is about 0 to about 100. Thus, the pixel-shifting ends at the (K+4)-th frame.

Figure 7:
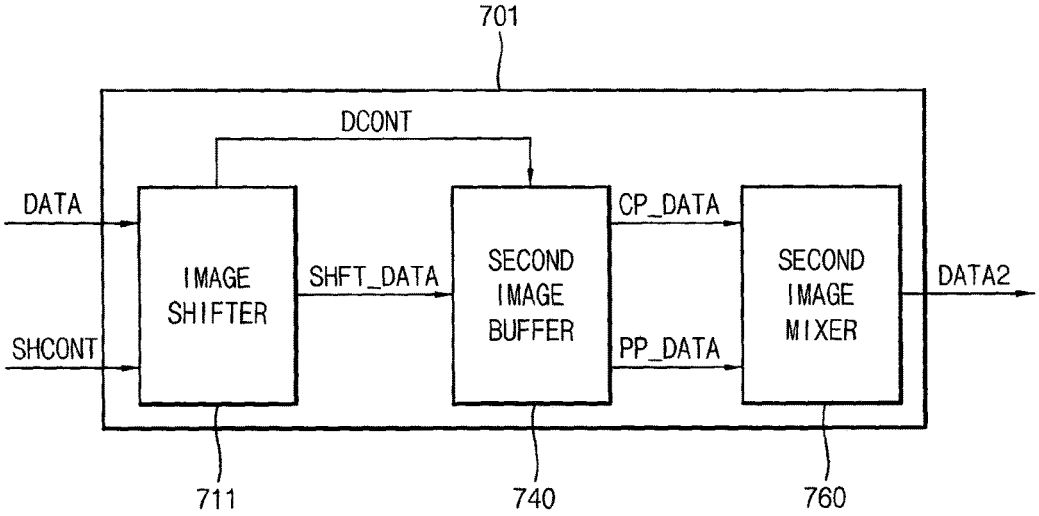
FIG. 7 is a block diagram illustrating an image processor according to another exemplary embodiment.
Figure 8:
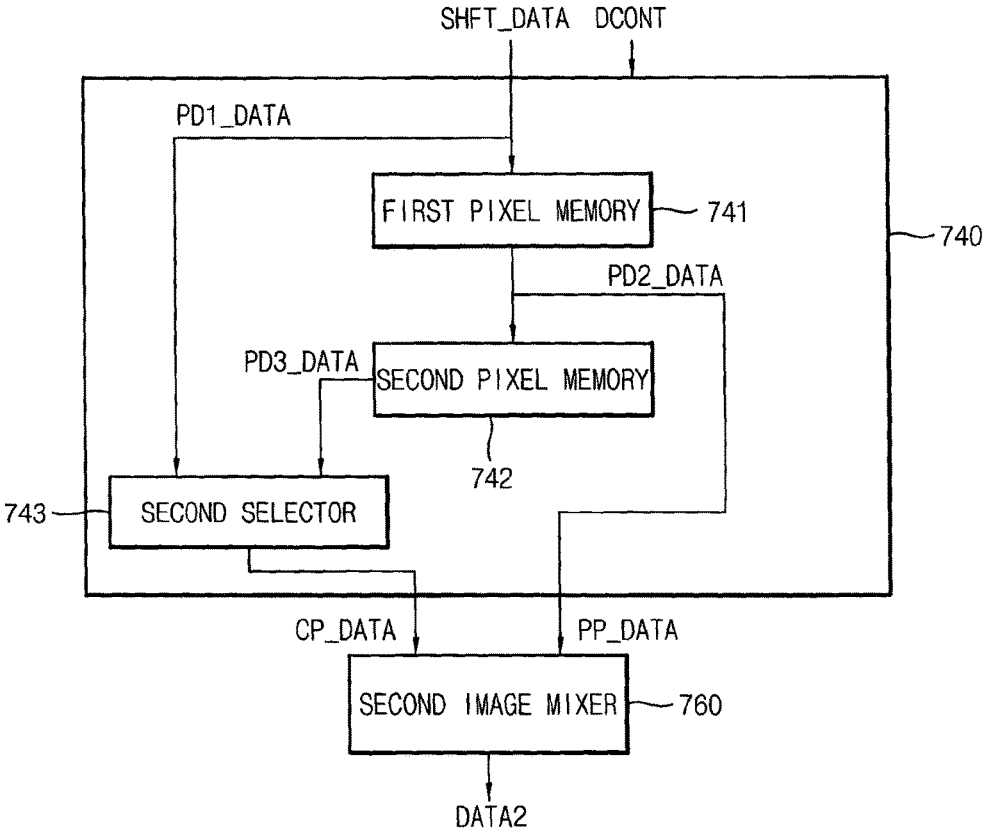
FIG. 8 is a block diagram illustrating the second image buffer and the second image mixer of FIG. 7.

FIG. 7 is a block diagram illustrating an image processor according to another exemplary embodiment. FIG. 8 is a block diagram illustrating the second image buffer and the second image mixer of FIG. 7.

In some embodiments, a display device is substantially the same as the display device illustrated in FIGS. 1 to 3 except for an image processor 701. Thus, the same reference numerals can be used for same elements as the display device illustrated in FIGS. 1 to 3. Furthermore, any duplicative explanation is omitted.

The image processor 701 pixel-shifts an image in the data signal DATA over a plurality of frames based at least in part on the shift start signal SHCONT to generate a second data signal DATA2, and outputs the second data signal DATA2 to the data driver 330. For example, the image processor 701 pixel-shifts the image by at least one pixel over consecutive M frames in the second direction D2 or in a fourth direction opposite to the second direction D2 based at least in part on the shift start signal SHCONT.

The image processor 701 includes an image shifter 711, a second image buffer 740 and a second image mixer 760.

The image shifter 711 can output a shift data signal SHFT_DATA, which is generated by pixel-shifting the data signal DATA in the second direction D2 or in the fourth direction based at least in part on the shift start signal SHCONT. The image shifter 711 can also output a shift direction signal DCONT.

The second image buffer 740 can output current pixel data CP_DATA and previous pixel data PP_DATA based at least in part on the shift data signal SHFT_DATA and the shift direction signal DCONT. For example, the shift start signal SHCONT is applied in the (K+1)th frame. The second image buffer 740 can output the current pixel data CP_DATA and the previous pixel data PP_DATA, which correspond to the pixels from the (K+1)th frame to (K+M)th frame.

The second image buffer 740 includes a first pixel memory 741, a second pixel memory, 742 and a second selector 743.

The first pixel memory 741 can output n-th pixel data PD2_DATA of the shift data signal SHFT_DATA and can store (n+1)-th pixel data PD1_DATA of the shift data signal SHFT_DATA. The n-th pixel data PD2_DATA can be outputted as the current pixel data CP_DATA.

The second pixel memory 742 can output (n−1)-th pixel data PD3_DATA of the shift data signal SHFT_DATA and can store the n-th pixel data PD2_DATA.

The second selector 743 can output one of the (n+1)-th pixel data PD1_DATA and the (n−1)-th pixel data PD3_DATA as the previous pixel data PP_DATA based at least in part on shift direction signal DCONT.

For example, when the image is pixel-shifted in the second direction D2, the (n+1)-th pixel data PD1_DATA is output as the previous pixel data PP_DATA. When the image is pixel-shifted in the fourth direction, the (n−1)-th pixel data PD3_DATA can be output as the previous pixel data PP_DATA.

The second image mixer 760 can mix the current pixel data CP_DATA and the previous pixel data PP_DATA over M frames starting from the frame receiving the shift start signal SHCONT to generate the second data signal DATA2. The second image mixer 760 can output the second data signal DATA2 to the data driver 330.

For example, the second image mixer 760 reduces the ratio of the previous pixel data PP_DATA and can increase the ratio of the current pixel data CP_DATA while the M frames progress. For example, the second image mixer 760 linearly reduce the ratio of the previous pixel data PP_DATA and linearly increase the ratio of the current pixel data CP_DATA. For example, the ratio of the previous pixel data PP_DATA is linearly reduced to be about ((M−L)/M)*100%, and the ratio of the current pixel data CP_DATA is linearly increased to be about (L/M)*100%, while the M frames progress. L is a natural number of 1 to M.

When M is 4, the second image mixer 760 mixes the current pixel data CP_DATA and the previous pixel data PP_DATA over 4 frames starting from a first frame.

In the first frame, L is 1. In the first frame, the second image mixer 760 mixes about 25% of the current pixel data CP_DATA and about 75% of the previous pixel data PP_DATA.

In a second frame, L is 2. In the second frame, the second image mixer 760 mixes about 50% of the current pixel data CP_DATA and about 50% of the previous pixel data PP_DATA.

In a third frame, L is 3. In the third frame, the second image mixer 760 mixes about 75% of the current pixel data CP_DATA and about 25% of the previous pixel data PP_DATA.

In a fourth frame, L is 4. In the fourth frame, the second image mixer 760 mixes about 100% of the current pixel data CP_DATA and about 0% of the previous pixel data PP_DATA.

In some embodiments, the second image mixer 760 reduces the ratio of the previous pixel data PP_DATA by a predetermined reducing rate, and increases the ratio of the current pixel data CP_DATA by a predetermined increasing rate while the M frames progress.

The previous pixel data PP_DATA and the current pixel data CP_DATA can include red, green and blue image data, which respectively correspond to each of the pixels.

For example, the second image mixer 760 mixes red image data of the previous pixel data PP_DATA with red image data of the current pixel data CP_DATA, and mixes green image data of the previous pixel data PP_DATA with green image data of the current pixel data CP_DATA, and mixes blue image data of the previous pixel data PP_DATA with blue image data of the current pixel data CP_DATA.

In some embodiments, the previous pixel data PP_DATA and the current pixel data CP_DATA includes cyan image data, yellow image data and magenta image data. The previous pixel data PP_DATA and the current pixel data CP_DATA can further include multi-primary image data.

The second image mixer 760 can mix cyan image data of the previous pixel data PP_DATA with cyan image data of the current pixel data CP_DATA, and mix yellow image data of the previous pixel data PP_DATA with yellow image data of the current pixel data CP_DATA, and mix magenta image data of the previous pixel data PP_DATA with magenta image data of the current pixel data CP_DATA. Furthermore, the second image mixer 760 can mix multi-primary image data of the previous pixel data PP_DATA with multi-primary image data of the current pixel data CP_DATA.

Processes for pixel-shifting over a plurality of frames will be explained in detail with reference to FIG. 9 to FIG. 10, hereinafter.

The data driver receives the second control signal CONT2 from the timing controller 500. The data driver 330 receives the second data signal DATA2 from the image processor 701. The data driver 330 receives the gamma reference voltage VGREF from the gamma reference voltage generator 350.

The data driver 330 converts the second data signal DATA2 into analog data voltages by using the gamma reference voltage VGREF. The data driver 330 outputs the data voltages to the data lines DL.

Figure 9:
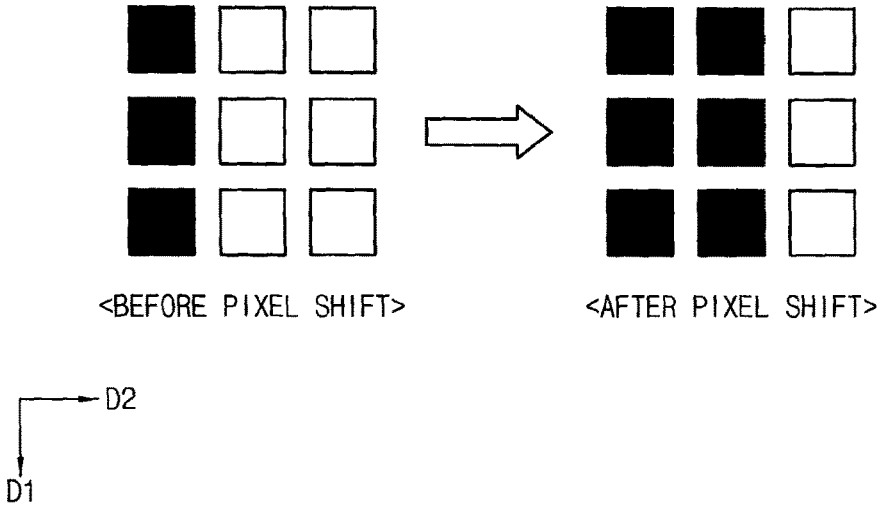
FIG. 9 is a schematic view illustrating an image before and after being shifted.

FIG. 9 is a schematic view illustrating an image before and after being shifted. FIG. 10 is a schematic view illustrating processes of shifting the image of FIG. 9.

Figure 10:
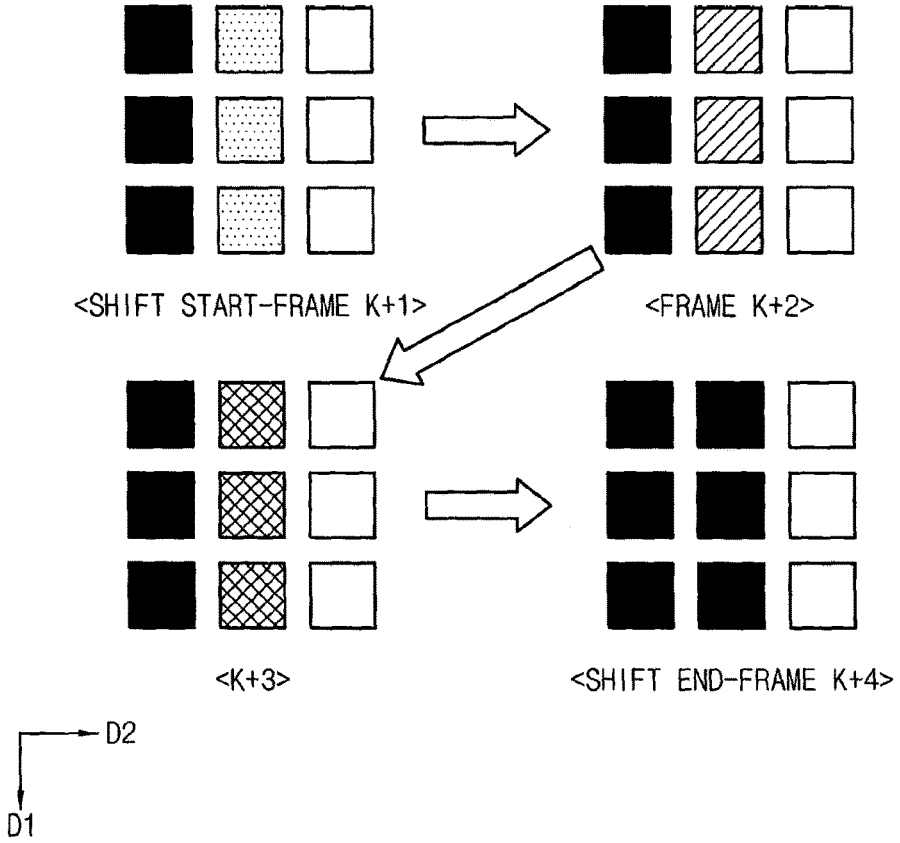
FIG. 10 is a schematic view explaining processes of shifting the image of FIG. 9.

Nine quadrangles illustrated in a left region of FIG. 10 are enlarged 9 pixels adjacent to each other in a display panel, and represents a state before pixel-shifted. Nine quadrangles illustrated in a right region of FIG. 10 are enlarged pixels same as the left-illustrated 9 pixels, and represents a state after pixel-shifted in the second direction D2.

Each of the pixels can include a red subpixel, a green subpixel and a blue subpixel. In some embodiments, each of the pixels includes a cyan subpixel, a yellow subpixel, and a magenta subpixel. The pixel can further include a multi-primary subpixel.

The 9 pixels include a first pixel formed in a (m−1)-th row and in a (n−1)-th column, a second pixel formed in the (m−1)-th row and in a n-th column, a third pixel formed in the (m−1)-th row and in a (n+1)-th column, a fourth pixel formed in a m-th row and in the (n−1)-th column, a fifth pixel formed in the m-th row and in the n-th column, a sixth pixel formed in the m-th row and in the (n+1)-th column, a seventh pixel formed in the (m+1)-th row and in the (n−1)-th column, an eighth pixel formed in the (m+1)-th row and in the n-th column, and a ninth pixel formed in the (m+1)-th row and in the (n+1)-th column.

Before pixel-shifting, the first, fourth and seventh pixels represent a first color, and the rest of the pixels represent a second color. For example, the first color is black, and the second color is white.

In some embodiments, pixel-shifting progresses over 4 frames, but it is not limited thereto. In some embodiments, the pixel-shifting progress over at least 2 frames.

For example, the pixel-shifting starts at (K+1)th frame and ends at (K+4)-th frame.

In the (K+1)-th frame, the first shift start signal SHCONT is applied to the image processor 701. Thus, the previous pixel data PP_DATA, which corresponds to data before the pixel-shifting, starts to be mixed with the current pixel data CP_DATA, which corresponds to data after the pixel-shifting in the second direction D2, in each line. Because a ratio of the current pixel data CP_DATA is less than a ratio of the previous pixel data PP_DATA in the (K+1)-th frame, the second, fifth and eighth pixels represent gray close to white in the (K+1)-th frame.

Because the ratio of the current pixel data CP_DATA is substantially the same as the ratio of the previous pixel data PP_DATA in the (K+2)-th frame, the second, fifth and eighth pixels represent gray between black and white in the (K+2)-th frame.

Because the ratio of the current pixel data CP_DATA is greater than the ratio of the previous pixel data PP_DATA in the (K+3)-th frame, the fourth, fifth and sixth pixels represent gray close to black in the (K+3)-th frame.

In the (K+4)-th frame, the ratio of the current pixel data CP_DATA becomes about 100%, and the ratio of the previous pixel data PP_DATA becomes about 0%. Thus, the second, fifth and eighth pixels represent black in the (K+4)-th frame.

Figure 11:
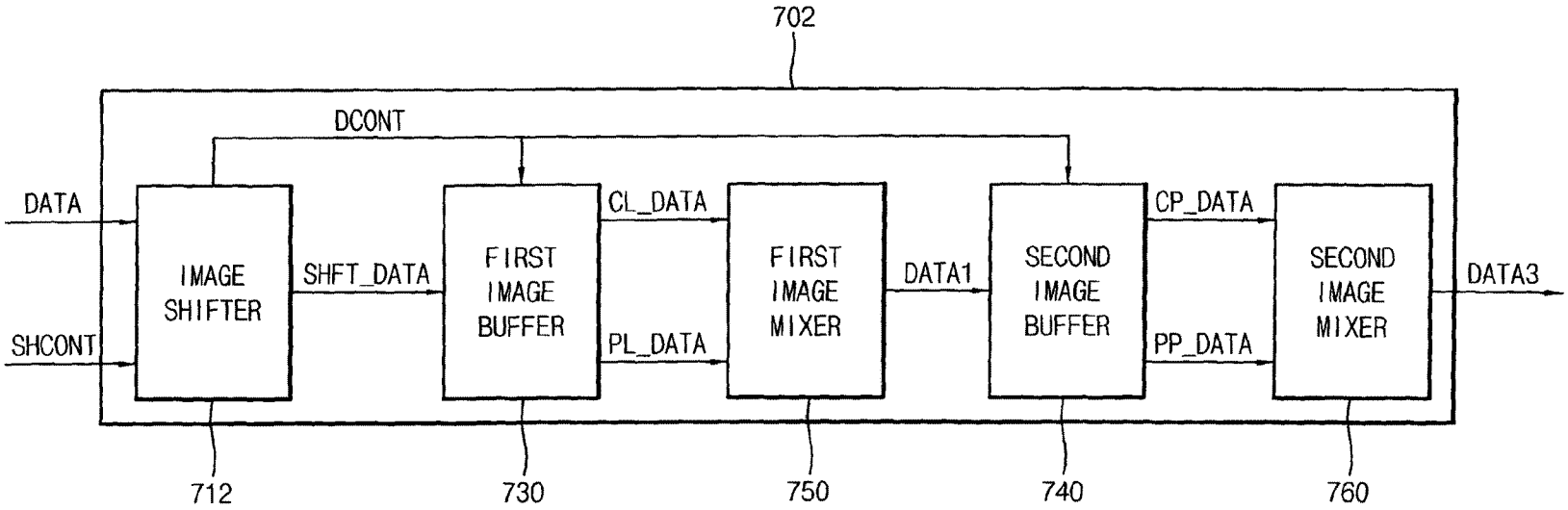
FIG. 11 is a block diagram illustrating an image processor according to still another exemplary embodiment.

FIG. 11 is a block diagram illustrating an image processor according to still another exemplary embodiment.

In some embodiments, a display device is substantially same as the display device illustrated in FIGS. 1 to 3, 7 and 8 except for an image processor 702. Thus, same reference numerals can be used for the same elements as the display device illustrated in FIGS. 1 to 3, 7 and 8. Furthermore, any duplicative explanation is omitted.

Referring to FIGS. 1 to 3, 7, 8 and 11, the image processor 702 pixel-shifts an image in the data signal DATA over a plurality of frames based at least in part on a shift start signal SHCONT to generate a third data signal DATA3, and outputs the third data signal DATA3 to the data driver 330. For example, the image processor 702 pixel-shifts the image by at least one pixel over consecutive M frames in the first direction D1 or in a third direction opposite to the first direction D1 based at least in part on the shift start signal SHCONT. Furthermore, the image processor 702 can pixel-shift the image by at least one pixel, which is one line, over consecutive M frames in the second direction D2 or in a fourth direction opposite to the second direction D2 based at least in part on the shift start signal SHCONT.

The image processor 702 includes an image shifter 712, a first image buffer 730, a first image mixer 750, a second image buffer 740 and a second image mixer 760.

The image shifter 712 can output a shift data signal SHFT_DATA, which is generated by pixel-shifting the data signal DATA in the first direction D1, in the second direction D2, in the third direction or in the fourth direction based at least in part on the shift start signal SHCONT, and a shift direction signal DCONT.

When the image shifter 712 pixel-shifts the data signal DATA in the first direction D1 and in the third direction, the first image buffer 730 and the first image mixer 750 do not operate. Thus, the shift data signal SHFT_DATA can be transmitted to the second image buffer 40 and the second image mixer 760 as a first data signal DATA1. The second image buffer 40 and the second image mixer 760 can mix the first data signal DATA1 through substantially the same method as the method explained with reference to FIGS. 7 to 10 to output the third data signal DATA3.

When the image shifter 712 pixel-shifts the data signal DATA in the second direction D2 and in the fourth direction, the first image buffer 730 and the first image mixer 750 can mix the data signal DATA through substantially the same method as the method explained with reference to FIGS. 1 to 5 to output the a first data signal DATA1. The second image buffer 40 and the second image mixer 760 do not operate. Thus, the first data signal DATA1 can be outputted as the third data signal DATA3.

According to the exemplary embodiments, an afterimage, which is caused when the same image is displayed on a display panel for a long time, can be prevented. Furthermore, when pixel-shifting is performed, the pixel-shifting is gradually performed over a plurality of frames. Thus, perception of the pixel-shifting can be prevented.

The exemplary embodiments can be employed for various display devices including a personal display device such as a television, a desktop monitor or the like, as well as a large-screen display device for a commercial display.

The foregoing is illustrative and is not to be construed as limiting thereof. Although a few exemplary embodiments have been described, those skilled in the art will readily appreciate that many modifications are possible in the exemplary embodiments without materially departing from the novel teachings, aspects, and advantages of the inventive technology. Accordingly, all such modifications are intended to be included within the scope of this disclosure.

What is claimed is:

1. An image processor for a display device, comprising:

an image shifter configured to i) receive a data signal and a shift start signal, ii) shift the data signal by at least one pixel based at least in part on the shift start signal, and iii) output a shifted data signal, and a shift direction signal, the shifted data signal being generated by pixel-shifting the data signal by at least one pixel in a first direction or in a third direction opposite to the first direction;

an image buffer configured to output current line data located in a first frame and previous line data located in a second frame preceding the first frame based at least in part on the shifted data signal and the shift direction signal; and an image mixer configured to i) mix the current line data located in the first frame and the previous line data located in the second frame over M frames starting at a start frame when the shift start signal is received and ii) output image data, wherein M is a natural number, wherein the shifted data signal comprises (m+1)-th, m-th and (m−1)-th line data that respectively correspond to pixel rows formed adjacent to each other, and wherein the image buffer includes:

a first line memory configured to store the (m+1)-th line data and output the m-th line data as the current line data;

a second line memory configured to store the m-th line data and output the (m−1)-th line data; and a first selector configured to output one of the (m+1)-th line data and the (m−1)-th line data as the previous line data based at least in part on the shift direction signal, wherein the (m+1)-th line data is outputted as the previous line data so that an image corresponding to the image data is pixel-shifted in the first direction, and the (m−1)-th line data is outputted as the previous line data so that the image corresponding to the image data is pixel-shifted in the third direction, wherein the image mixer is further configured to linearly reduce a ratio of the previous line data and to linearly increase a ratio of the current line data while the M frames progress away from the start frame, wherein the ratio of the previous line data is linearly reduced to be ((M−L)/M)*100%, and the ratio of the current line data is linearly increased to be (L/M)*100%, while the M frames progress, wherein L is a natural number between 1 to M, wherein the current line data and the previous line data each includes first to third color data, which correspond to a plurality of pixels, wherein the image mixer is further configured to, for each of the pixels, mix the first color data of the previous line data with the first color data of the current line data, the second color data of the previous line data with the second color data of the current line data, and the third color data of the previous line data with the third color data of the current line data for each of the pixels.

2. The image processor of claim 1, wherein the image shifter is further configured to shift the data signal by at least one pixel in a second direction crossing a first direction or in a fourth direction opposite to the second direction.

3. The image processor of claim 1, wherein the previous line data includes data of a plurality of first pixels on a first row, and wherein the current line data includes data of a plurality of second pixels on a second row different from the first row.

4. A display device comprising:

a display panel configured to display an image;

an image processor electrically connected to the display panel and including:

an image shifter configured to i) receive a data signal and a shift start signal, ii) shift the data signal by at least one pixel based at least in part on the shift start signal, and iii) output a shifted data signal, and a shift direction signal, the shifted data signal being generated by pixel-shifting the data signal by at least one pixel in a first direction or in a third direction opposite to the first direction;

an image buffer configured to output current line data located in a first frame and previous line data located in a second frame preceding the first frame based at least in part on the shifted data signal and the shift direction signal; and an image mixer configured to i) mix the current line data located in the first frame and the previous line data located in the second frame over M frames starting at a start frame when the shift start signal is received and ii) output image data, wherein M is a natural number; and a data driver configured to output a data voltage to the display panel based at least in part on the image data, wherein the shifted data signal comprises (m+1)-th, m-th and (m−1)-th line data that respectively correspond to pixel rows formed adjacent to each other, and wherein the image buffer includes:

a first line memory configured to store the (m+1)-th line data and output the m-th line data as the current line data;

a second line memory configured to store the m-th line data and output the (m−1)-th line data; and a first selector configured to output one of the (m+1)-th line data and the (m−1)-th line data as the previous line data based at least in part on the shift direction signal, wherein the (m+1)-th line data is outputted as the previous line data so that an image corresponding to the image data is pixel-shifted in the first direction, and the (m−1)-th line data is outputted as the previous line data so that the image corresponding to the image data is pixel-shifted in the third direction, wherein the image mixer is further configured to linearly reduce a ratio of the previous line data and to linearly increase a ratio of the current line data while the M frames progress away from the start frame, wherein the ratio of the previous line data is linearly reduced to be ((M−L)/M)*100%, and the ratio of the current line data is linearly increased to be (L/M)*100%, while the M frames progress, wherein L is a natural number between 1 to M, wherein the current line data and the previous line data each includes first to third color data, which correspond to a plurality of pixels, wherein the image mixer is further configured to, for each of the pixels, mix the first color data of the previous line data with the first color data of the current line data, the second color data of the previous line data with the second color data of the current line data, and the third color data of the previous line data with the third color data of the current line data for each of the pixels.

5. A method for driving a display panel, the method comprising:

receiving a data signal and a shift start signal in an image shifter;

pixel-shifting the data signal by at least one pixel based at least in part on the shift start signal so as to output a shifted data signal and a shift direction signal, the shifted data signal being generated by pixel-shifting the data signal by at least one pixel in a first direction or in a third direction opposite to the first direction;

storing the shifted data signal in an image buffer;

outputting current line data located in a first frame and previous line data located in a second frame, preceding the first frame, from the stored shifted data signal based at least in part on the shifted data signal and the shift direction signal;

mixing the current line data located in the first frame and the previous line data located in the second frame over M frames starting from a start frame when the shift start signal is received so as to output image data, wherein M is a natural number; and outputting a data voltage to a display panel based at least in part on the image data, wherein the shifted data signal comprises (m+1)-th, m-th and (m−1)-th line data that respectively correspond to pixel rows formed adjacent to each other, and wherein the outputting of the current line data and the previous line data comprises:

storing the (m+1)-th line data in a first line memory and outputting m-th line data from the first line memory as the current line data;

storing the m-th line data in a second line memory and outputting the (m−1)-th line data from the second line memory; and outputting from a selector one of the (m+1)-th line data and the (m−1)-th line data as the previous line data based at least in part on the shift direction signal, wherein the (m+1)-th line data is outputted as the previous line data so that an image corresponding to the image data is pixel-shifted in the first direction, and the (m−1)-th line data is outputted as the previous line data so that the image corresponding to the image data is pixel-shifted in the third direction, wherein a ratio of the previous line data is linearly reduced and a ratio of the current line data is linearly increased while the M frames progress away from the start frame, wherein the ratio of the previous line data is linearly reduced to be ((M−L)/M)*100%, and the ratio of the current line data is linearly increased to be (L/M)*100%, while the M frames progress, wherein L is a natural number between 1 to M, wherein the current line data and the previous line data each includes first to third color data, which correspond to a plurality of pixels, wherein the image mixer is further configured to, for each of the pixels, mix the first color data of the previous line data with the first color data of the current line data, the second color data of the previous line data with the second color data of the current line data, and the third color data of the previous line data with the third color data of the current line data for each of the pixels.

* * * * *